US010889907B2

(12) United States Patent
Foyet et al.

(10) Patent No.: US 10,889,907 B2
(45) Date of Patent: Jan. 12, 2021

(54) CYANIDE-FREE ACIDIC MATTE SILVER ELECTROPLATING COMPOSITIONS AND METHODS

(71) Applicant: Rohm and Haas Electronic Materials LLC, Marlborough, MA (US)

(72) Inventors: Adolphe Foyet, Lucerne (CH); Wan Zhang-Beglinger, Adligenswil (CH); Margit Clauss, Kriens (CH)

(73) Assignee: Rohm and Haas Electronic Materials LLC, Marlborough, MA (US)

( * ) Notice: Subject to any disclaimer, the term of this patent is extended or adjusted under 35 U.S.C. 154(b) by 522 days.

(21) Appl. No.: 14/186,081

(22) Filed: Feb. 21, 2014

(65) Prior Publication Data

US 2015/0240375 A1 Aug. 27, 2015

(51) Int. Cl.
*C25D 3/46* (2006.01)

(52) U.S. Cl.
CPC ..... *C25D 3/46* (2013.01)

(58) Field of Classification Search
CPC ..... C25D 3/46; C25D 3/64
USPC ..... 205/238, 263
See application file for complete search history.

(56) References Cited

U.S. PATENT DOCUMENTS

| | | | | |
|---|---|---|---|---|
| 4,024,031 | A | 5/1977 | Lerner | |
| 4,067,784 | A | 1/1978 | Leahy et al. | |
| 4,246,077 | A | 1/1981 | Hradil et al. | |
| 5,302,278 | A | 4/1994 | Nobel et al. | |
| 7,628,903 | B1 * | 12/2009 | Tsuji | C25D 3/46 106/1.23 |
| 7,780,839 | B2 | 8/2010 | Egli et al. | |
| 7,968,444 | B2 | 6/2011 | Luo et al. | |
| 8,349,393 | B2 | 1/2013 | Yau et al. | |
| 8,888,984 | B2 | 11/2014 | Lee et al. | |
| 2006/0283714 | A1 * | 12/2006 | Egli et al. | 205/242 |
| 2009/0188807 | A1 | 7/2009 | Egli et al. | |
| 2012/0067735 | A1 | 3/2012 | Clauss et al. | |
| 2013/0256145 | A1 * | 10/2013 | Romer | C25D 3/60 205/253 |

FOREIGN PATENT DOCUMENTS

| | | |
|---|---|---|
| CN | 101092724 | 12/2007 |
| CN | 101260551 B | 9/2008 |
| CN | 101514465 | 8/2009 |
| CN | 101760768 A | 6/2010 |
| CN | 101781782 A | 7/2010 |

(Continued)

OTHER PUBLICATIONS

Gonnissen et al., "Modeling the Effects of 1-Phenyl-5-Mercaptotetrazole on the Electrocrystallization of Silver", Proceedings—Electrochemical Society (no month, 2000), vol. 99-33 (Fundamental Aspects of Electrochemical Deposition and Dissolution), pp. 71-83. Abstract only.*

(Continued)

*Primary Examiner* — Edna Wong
(74) *Attorney, Agent, or Firm* — John J. Piskorski

(57) ABSTRACT

Cyanide-free acidic silver electroplating compositions include one or more acids or salts of tellurium and may be used to electroplate matte silver deposits on metals, such as nickel, copper or copper alloys. Matte silver metal may be electroplated at conventional plating rates or at high plating rates, such as in reel-to-reel and jet plating. The cyanide-free acidic silver electroplating compositions may be used to electroplate matte silver in the manufacture of electronic components such as electrical connectors, finishing layers for metallic substrates, optical devices and decorative applications.

6 Claims, 4 Drawing Sheets a b

(56) References Cited

FOREIGN PATENT DOCUMENTS

| | | | | | |
|---|---|---|---|---|---|
| CN | 101260549 | B | | 8/2010 | |
| CN | 102168290 | A | | 8/2011 | |
| CN | 102560571 | A | | 7/2012 | |
| CN | 102995081 | A | | 3/2013 | |
| CN | 103160890 | A | | 6/2013 | |
| EP | 2626449 | A2 | * | 8/2013 | ..... C25D 3/56 |
| GB | 1283024 | A | * | 7/1972 | ..... C25D 3/64 |
| GB | 1419613 | | | 12/1975 | |
| JP | 07180085 | | | 7/1997 | |

OTHER PUBLICATIONS

Gonnissen et al., "Modeling the Effects of 1-Phenyl-5-Mercaptotetrazole on the Electrocrystallization of Silver", Proceedings—Electrochemical Society (no month, 2000), vol. 99-33 (Fundamental Aspects of Electrochemical Deposition and Dissolution), pp. 71-83.*

Samarcev, "Inhibition Phenomena in the Electrolytic Formation and Growth of Metal Crystals," Acta Physicochimica URSS (no month, 1942), vol. 16, pp. 206-235.*

European Search Report corresponding to European Application No. 15155932.5 dated Jul. 10, 2015.

Taiwan Search Report corresponding to Taiwan Application No. 104105793 dated Dec. 18, 2015.

Search report for corresponding Chinese Application No. 201510218345.9 dated Sep. 28, 2016.

Sigma-Aldrich 1[2-(Dimethylamino)ethyl]-1H-tetrazole-5-thiol, http://www.sigmaaldrich.com/catalog/products/aldrich/52233?lang=en&region=US, dated Sep. 8, 2017.

* cited by examiner

1a

1b

CYANIDE-FREE ACIDIC MATTE SILVER ELECTROPLATING COMPOSITIONS AND METHODS

FIELD OF THE INVENTION

The present invention is directed to stable cyanide-free acidic matte silver electroplating compositions and methods. More specifically, the present invention is directed to stable cyanide-free acidic matte silver electroplating compositions and methods where silver may be electroplated at high speeds and still provide a substantially uniform matte silver deposit with good hardness, ductility and conductivity.

BACKGROUND OF THE INVENTION

Silver electroplating has been conventionally used for decoration and for dinner wares. Owing to its excellent electric characteristics, silver electroplating has had a wide utility in the electronics industry, such as for switches, electrical connectors and components for optical devices.

Many conventional silver electroplating solutions are very toxic because they contain cyanide compounds. Typically the source of the silver ions of the electroplating solution is from a water soluble silver cyanide salt. Many of such cyanide containing silver electroplating baths are alkaline and may cause corrosion of metal components and substrates, thus they cannot be used to electroplate silver on various commercial products. In addition, the hardness of silver deposited from cyanide containing alkaline silver electroplating baths typically softens after exposure to high temperatures such as 150° C. and greater. This is undesirable where the silver is deposited on articles which are exposed to heat and the decrease in silver hardness compromises the performance and longevity of the articles.

Attempts have been made to reduce or eliminate cyanide compounds from silver electroplating solutions and at the same time maintain the desired plating performance of the silver electroplating solutions and achieve a matte silver deposit. Cyanide-free silver electroplating solutions are less toxic to both workers in the industries and are more environmentally friendly because waste water from the solutions does not contaminate the environment with cyanide. Overall process safety is improved with cyanide-free silver electroplating solutions. Some are even acidic. However, in general, such cyanide-free silver electroplating solutions have not been very stable and have not always performed to the satisfaction of the plating industries. The solutions typically decompose during electroplating and the silver ions in the solution are often reduced prior to deposition on the substrate, thus shortening the life of the solutions. There is also room for improvement in the maximum applicable current density as well as the physical properties of the silver deposits. Such cyanide-free silver electroplating solutions typically have not deposited uniform silver layers and have had generally poor surface appearance. Many cyanide-free silver electroplating solutions have not been found to be suitable for industrial use in high-speed plating where current densities exceed 5 A/dm$^2$. Accordingly, there is a need for chemically and electrochemically stable cyanide-free acidic silver electroplating compositions which provide substantially uniform matte silver deposits with good microhardness, ductility, conductivity, solderability and may be electroplated at high speeds.

SUMMARY OF THE INVENTION

An acidic silver electroplating composition including one or more sources of silver ions, one or more acids, one or more sources of tellurium, one or more compounds having a formula:

HO—R—S—R'—S—R"—OH (I)

wherein R, R' and R" are the same or different and are linear or branched alkylene radicals having from 1 to 20 carbon atoms; and one or more compounds having a formula:

(II)

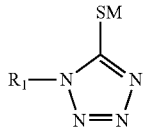

wherein M is hydrogen, $NH_4$, sodium or potassium and $R_1$ is substituted or unsubstituted, linear or branched ($C_2$-$C_{20}$) alkyl, or substituted or unsubstituted ($C_6$-$C_{10}$)aryl; the acidic silver electroplating composition is substantially free of cyanide.

A method of electroplating silver including: a) contacting a substrate with a silver electroplating composition including one or more sources of silver ions, one or more acids, one or more sources of tellurium, one or more compounds having a formula:

HO—R—S—R'—S—R"—OH (I)

wherein R, R' and R" are the same or different and are linear or branched alkylene radicals having from 1 to 20 carbon atoms; and one or more compounds having a formula:

(II)

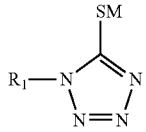

wherein M is hydrogen, $NH_4$, sodium or potassium and $R_1$ is substituted or unsubstituted, linear or branched ($C_2$-$C_{20}$) alkyl, or substituted or unsubstituted ($C_6$-$C_{10}$)aryl; the silver electroplating composition is substantially free of cyanide; and b) electroplating matte silver on the substrate.

In addition to being environmentally and worker friendly due to being substantially free of cyanide, the acidic silver electroplating composition deposits a substantially uniform matte deposit on metal containing substrates. The cyanide-free acidic silver electroplating composition is both chemically and electrochemically stable. Since the silver electroplating composition is acidic, it can be used to plate silver metal on substrates which typically corrode in alkaline environments. The matte silver deposit displays good microhardness before and after annealing and its ductility, contact resistance and solderability are comparable to silver deposits plated from many conventional cyanide containing silver electroplating baths. The matte silver deposit also has good corrosion resistance. The silver electroplating composition may be used to deposit substantially uniform matte silver at conventional as well as high speed plating rates such as in reel-to-reel and jet electroplating processes. The ability to electroplate silver at such high electroplating speeds resulting in substantially uniform matte silver deposits improves silver electroplating efficiency for industries such as those which use electroplated silver for finishing layers on metal substrates, connectors for electrical and optical devices and decorative applications.

DETAILED DESCRIPTION OF THE INVENTION

Figure 1:
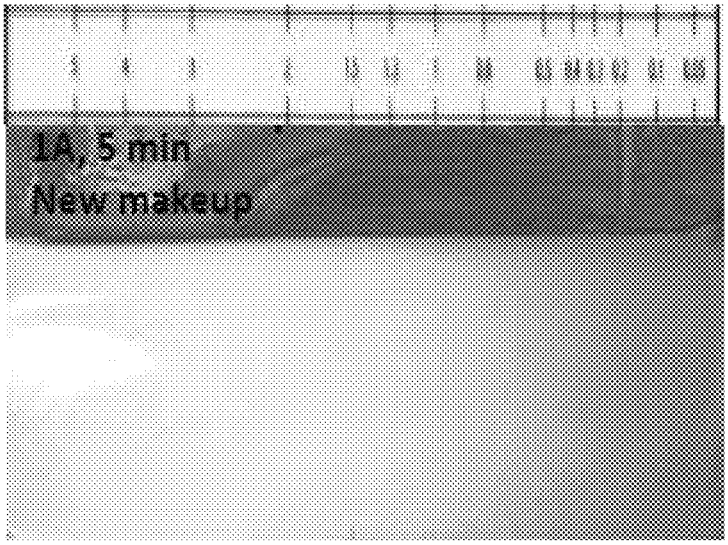
FIGS. 1*a* and 1*b* are photographs of a Hull cell test of silver deposited from a cyanide-free acidic silver electroplating bath on brass substrates at initial bath makeup and after a bath age of 40 Ah/L, respectively.
Figure 1:
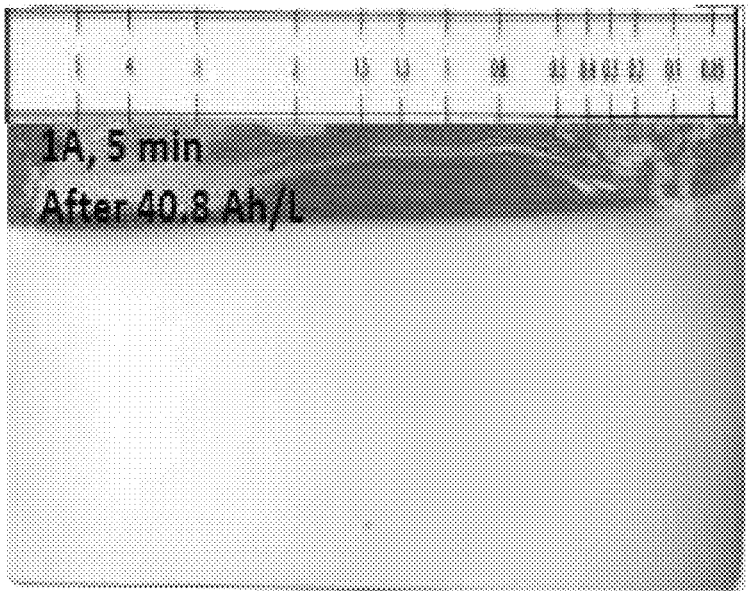

As used throughout the specification, the following abbreviations have the following meanings, unless the context clearly indicates otherwise: ° C.=degrees Centigrade; g=gram; mg=milligrams; cm=centimeters; mm=millimeters; mL=milliliter; L=liter; ppm=parts per million=mg/L; DI=de-ionized; μm=microns; wt %=percent by weight; A=amps; A/dm$^2$ and ASD=amps per square decimeter; Ah=ampere hours; HV=hardness values; cN=centiNewtons; mOhm=milliOhms; CE=current efficiency; Ag=silver; EO/PO=ethylene oxide/propylene oxide non-ionic surfactant; and ASTM=American standard testing method.

Electroplating potentials are provided with respect to a hydrogen reference electrode. Relating to the electroplating process, the terms "depositing", "electroplating" and "plating" are used interchangeably throughout this specification. "Halide" refers to fluoride, chloride, bromide and iodide. "Matte" means dull and flat, without a shine. "Acidic" means comprising an acid and having a pH below 7. "Ah" is the amount of energy charge that will allow one ampere of current to flow for one hour. The term "composition" and "bath" are used interchangeably throughout the specification. Telluric acid has the formula: $H_2TeO_4.2H_2O$ or $H_6TeO_6$. Tellurous acid has the formula: $H_2TeO_3$.

All percentages are by weight, unless otherwise noted. All numerical ranges are inclusive and combinable in any order, except where it is logical that such numerical ranges are construed to add up to 100%.

The acidic silver electroplating compositions deposit substantially uniform matte silver metal on substrates. The acidic silver electroplating compositions are chemically and electrochemically stable. The acidic silver electroplating baths are substantially free of cyanide and other metals. Cyanide is primarily avoided by not including any silver salts or other compounds in the baths which include the $CN^-$ anion.

The silver metal layers plated from the acidic silver electroplating compositions have low electrical resistance, thus they are good conductors and have good solderability. The silver deposits also have good ductility. Accordingly, the silver deposits are suitable for finishing layers on electrical components for electronic devices.

The electroplating compositions include one or more sources of silver ions. Sources of silver ions may be provided by silver salts such as, but are not limited to, silver halides, silver gluconate, silver citrate, silver lactate, silver nitrate, silver sulfates, silver alkane sulfonates, silver alkanol sulfonates and silver oxide. When a silver halide is used, it is preferable that the halide is chloride. Preferably the silver salts are silver sulfate, a silver alkane sulfonate or mixtures thereof, and more preferably silver sulfate, silver methane sulfonate or mixtures thereof. When replenishing the silver ions during electroplating, preferably the source of silver ions is silver oxide. The silver salts are generally commercially available or may be prepared by methods described in the literature. Preferably the silver salts are readily water-soluble. Silver salts in the composition may range from 5 g/L to 100 g/L, preferably from 10 g/L to 80 g/L.

The electroplating compositions include one or more sources of tellurium. Such compounds include, but are not limited to, telluric acid, tellurous acid, organotellurium compounds and tellurium dioxide. Organotellurium compounds include, but are not limited to, tellurol, telluroaldehyde, telluroketone, telluride, ditelluride, telluroxide, tellurone, tellurinic acid, alkyltellurium halides, dialkyltellurium dihalides, alkyltellurium trihalides, trialkyltellurium halides, dimethyl telluride and diphenyl ditelluride. Preferably the source of tellurium is telluric acid and tellurous acid. More preferably the source of tellurium is telluric acid. While not being bound by theory, the tellurium is believed to function as a grain refiner for providing a uniform silver metal deposit and reduces surface roughness of the silver deposit. Roughness results in an undesirable appearance of the silver deposit. In addition tellurium reduces silver porosity or prevents a porous, thus unsatisfactory silver deposit. When a soluble anode is used to plate silver, tellurium may inhibit anode passivation which results in an undesirable silver deposit. Accordingly, when tellurium is included in the plating compositions, low anode to cathode surface area ratios such as 1 to 2 may be used for electroplating matte silver. The one or more sources of tellurium are included in the silver electroplating compositions in amounts of 50 mg/L to 2 g/L, preferably from 100 mg/L to 1 g/L. More preferably the one or more sources of tellurium are included in the compositions in amounts of 200 mg/L to 800 mg/L.

The acidic silver electroplating compositions include one or more compounds having the following formula:

$$HO—R—S—R'—S—R''—OH \quad (I)$$

wherein R, R' and R" are the same or different and are linear or branched alkylene radicals having from 1 to 20 carbon atoms, preferably from 1 to 10 carbon atoms, more preferably R and R" have 2 to 10 carbon atoms and R' has 2 carbon atoms. Such compounds are known as dihydroxy bis-sulfide compounds. They are included in the silver electroplating compositions in amounts of 1 g/L to 100 g/L, preferably from 10 g/L to 80 g/L.

Examples of such dihydroxy bis-sulfide compounds are 2,4-dithia-1,5-pentanediol, 2,5-dithia-1,6-hexanediol, 2,6-dithia-1,7-heptanediol, 2,7-dithia-1,8-octanediol, 2,8-dithia-1,9-nonanediol, 2,9-dithia-1,10-decanediol, 2,11-dithia-1,12-dodecanediol, 5,8-dithia-1,12-dodecanediol, 2,15-dithia-1,16-hexadecanediol, 2,21-dithia-1,22-doeicasanediol, 3,5-dithia-1,7-heptanediol, 3,6-dithia-1,8-octanediol, 3,8-dithia-1,10-decanediol, 3,10-dithia-1,8-dodecanediol, 3,13-dithia- 1,15-pentadecanediol, 3,18-dithia-1,20-eicosanediol, 4,6-dithia-1,9-nonanediol, 4,7-dithia-1,10-decanediol, 4,11-dithia-1,14-tetradecanediol, 4,15-dithia-1,18-octadecanediol, 4,19-dithia-1,22-dodeicosanediol, 5,7-dithia-1,11-undecanediol, 5,9-dithia-1,13-tridecanediol, 5,13-dithia-1,17-heptadecanediol, 5,17-dithia-1,21-uneicosanediol and 1,8-dimethyl-3,6-dithia-1,8-octanediol.

The silver electroplating compositions also include mercaptotetrazole compounds having the following formula:

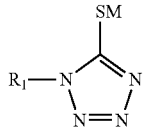

(II)

where M is hydrogen, $NH_4$, sodium or potassium and $R_1$ is substituted or unsubstituted, linear or branched ($C_2$-$C_{20}$) alkyl, substituted or unsubstituted ($C_6$-$C_{10}$)aryl, preferably substituted or unsubstituted, linear or branched ($C_2$-$C_{10}$) alkyl and substituted or unsubstituted ($C_6$)aryl, more preferably substituted or unsubstituted, linear or branched ($C_2$-$C_{10}$)alkyl. Substituents include, but are not limited to alkoxy, phenoxy, halogen, nitro, amino, substituted amino, sulfo, sulfamyl, substituted sulfamyl, sulfonylphenyl, sulfonylalkyl, fluorosulfonyl, sulfoamidophenyl, sulfonamide-alkyl, carboxy, carboxylate, ureido carbamyl, carbamyl-phenyl, carbamylalkyl, carbonylalkyl and carbonylphenyl. Preferred substituents include amino and substituted amino groups. Examples of mercaptotetrazoles are 1-(2-dimethylaminoethyl)-5-mercapto-1,2,3,4-tetrazole 1-(2-diethylaminoethyl)-5-mercapto-1,2,3,4-tetrazole, 1-(3-ureidophenyl)-5-mercaptotetrazole, 1-((3-N-ethyl oxalamido)phenyl)-5-mercaptotetrazole, 1-(4-acetamidophenyl)-5-mercaptotetrazole and 1-(4-carboxyphenyl)-5-mercaptotetrazole. In general, the mercaptotetrazole compounds of formula (II) are included in the bath in amounts of 1 g/L to 200 g/L, preferably from 5 g/L to 160 g/L.

While not being bound by theory, the combination of one or more compounds of formulae (I) and (II) provide stability to the silver baths during storage and during electroplating over the applicable current density range such that substantially uniform matte silver may be deposited. In addition, the silver deposits are more resistant to corrosion. Preferably the concentration ratio of the compounds of formula (II) to the compounds of formula (I) range from 0.5:1 to 2:1 in the acidic silver electroplating composition.

Any aqueous soluble acid which does not otherwise adversely affect the bath may be used. Suitable acids include, but are not limited to, arylsulfonic acids, alkanesulfonic acids, such as methanesulfonic acid, ethanesulfonic acid and propanesulfonic acid, aryl sulfonic acids such as phenylsulfonic acid and tolylsulfonic acid, and inorganic acids such as sulfuric acid, sulfamic acid, hydrochloric acid, hydrobromic acid and fluoroboric acid. Typically, the acids are alkane sulfonic acids and aryl sulfonic acids. Although a mixture of acids may be used, it is typical that a single acid is used. The acids are generally commercially available or may be prepared by methods known in the literature. Sufficient amounts of acid are included in the electroplating compositions to provide a pH of less than 7, preferably 2 or less and more preferably from 1 to less than 1. In general, acids are included in the electroplating compositions in amounts of 20 g/L to 250 g/L, typically from 30 g/L to 150 g/L.

Optionally, one or more suppressors may be included in the baths. Typically they are used in amounts of 0.5 to 15 g/L or such as from 1 to 10 g/L. Such suppressors include, but are not limited to, alkanol amines, polyethyleneimines and alkoxylated aromatic alcohols. Suitable alkanol amines include, but are not limited to, substituted or unsubstituted methoxylated, ethoxylated, and propoxylated amines, for example, tetra(2-hydroxypropyl)ethylenediamine, 2-{[2-(dimethylamino)ethyl]-methylamino}ethanol, N,N'-bis(2-hydroxyethyl)-ethylenediamine, 2-(2-aminoethylamine)-ethanol, and combinations thereof.

Suitable polyethyleneimines include, but are not limited to, substituted or unsubstituted linear or branched chain polyethyleneimines or mixtures thereof having a weight average molecular weight of from 800-750,000. Suitable substituents include, for example, carboxyalkyl, for example, carboxymethyl, carboxyethyl.

Useful alkoxylated aromatic alcohols include, but are not limited to ethoxylated bis phenol, ethoxylated beta naphthol, and ethoxylated nonyl phenol.

For applications requiring good wetting capabilities, one or more surfactants may be included in the baths. Suitable surfactants are known to those skilled in the art, and include those which yield deposits having good solderability, good matte finish, satisfactory grain refinement, and are stable in the acidic electroplating baths. Preferably low foaming surfactants are used. Conventional amounts may be used.

The acidic silver electroplating baths are preferably low foaming. Low foaming electroplating baths are highly desirable in the metal plating industry since the more the electroplating bath foams during plating, the more components the bath looses per unit of time during plating. Loss of components during plating may result in producing commercially inferior silver. Accordingly, workers must closely monitor component concentrations and replace lost components to their original concentration. Monitoring component concentrations during plating may be both tedious and difficult since some of the critical components are included at relatively low concentrations such that they are difficult to accurately measure and replace to maintain optimum plating performance. Low foaming electroplating baths improve silver deposit uniformity and thickness uniformity across a substrate surface and may reduce organics and gas bubbles trapped in the deposit which cause voids in the deposit after reflow.

Other optional compounds may be added to the baths to provide further grain refinement. Such compounds include, but are not limited to: alkoxylates, such as the polyethoxylated amines JEFFAMINE T-403 or TRITON RW, or sulfated alkyl ethoxylates, such as TRITON QS-15, and gelatin or gelatin derivatives. Alkoxylated amine oxides also may be included. While a variety of alkoxylated amine-oxide surfactants are known, preferably low-foaming amine oxides are used. Such preferred alkoxylated amine oxide surfactants have viscosities of less than 5000 cps measured using a Brookfield LVT Viscometer with a #2 spindle. Typically this viscosity is determined at ambient temperatures. Conventional amounts of such grain refiners may be used. Typically they are included in the baths in amounts of 0.5 g/l to 20 g/L.

The electroplating baths may be prepared by adding to a vessel one or more of the acids, one or more of the compounds of formulae (I) and (II) followed by one or more of the silver and tellurium compounds, one or more optional additives, and the balance water. Preferably the compounds of formulae (I) and (II) are added to the vessel before the silver and tellurium compounds. Preferably the molar ratio of the compounds of formula (II) to silver ions in the electroplating composition is 0.5:1 to 2:1. Once the aqueous bath is prepared, undesired material can be removed, such as by filtration and then water is typically added to adjust the final volume of the bath. The bath may be agitated by any known means, such as stirring, pumping, or recirculating, for increased plating speed.

The baths are useful in many electroplating methods where a uniform matte silver layer is desired. Plating methods include, but are not limited to barrel plating, rack plating and high speed plating such as reel-to-reel and jet plating. A uniform matte silver layer may be deposited on a substrate by the steps of contacting the substrate with the electroplating composition and passing a current through the composition to deposit the uniform matte silver on the substrate. The acidic silver electroplating compositions are stable during electroplating and may deposit uniform matte silver deposits on substrates over a bath age up to 40 Ah/L or greater without requiring bath replacement. Typically the bath ages may range from 10 Ah/L to 100 Ah/L.

Substrates which may be plated include, but are not limited to, copper, copper alloys, nickel, nickel alloys, brass containing materials, electronic components, such as electrical connectors and optical components. The baths also may be used for electroplating jewelry and decorative articles. The substrate may be contacted with the bath in any manner known in the art.

Current density used to plate the silver depends on the particular plating method. Generally, the current density is 0.05 A/dm$^2$ or higher or such as from 1 A/dm$^2$ to 25 A/dm$^2$. Typically low current densities range from 0.05 A/dm$^2$ to 5 A/dm$^2$. High current densities such as in reel-to-reel and jet plating with high agitation exceed 5 A/dm$^2$ and may be as high as 25 A/dm$^2$ or greater. Typically high speed electroplating is from 10 A/dm$^2$ to 30 A/dm$^2$.

The silver may be electroplated at temperatures from room temperature to 70° C., preferably from 55° C. to 70° C. More preferably silver metal is electroplated at temperatures from 60° C. to 70° C.

In general, the uniform matte silver deposits provide as hard or a harder deposit than silver electroplated from many conventional cyanide silver alkaline baths. Even after exposure to high temperatures of 150° C. or higher, typically from 150° C. to 300° C., the hardness of the silver remains substantially the same and does not substantially decrease. Hardness may be measured using conventional methods known in the art. Accordingly, the uniform matte silver may be used for hard finishes on connectors where wear resistance is required. Typically such finishes range in thickness from 0.4 μm to 5 μm. The silver deposit is typically 98 wt % or greater silver. More typically the silver deposit is 99 wt % or greater silver.

The following examples are intended to further illustrate the invention, but are not intended to limit the scope of the invention.

Example 1

A cyanide-free acidic silver electroplating composition was prepared having the components shown in Table 1 below:

TABLE 1

| COMPONENT | AMOUNT |
|---|---|
| Silver ions from silver methane sulfonate | 40 g/L |
| Methane sulfonic acid | 178 g/L |
| 3,6-dithia-1,8-octanediol | 67 g/L |
| 1-(2-dimethylaminoethyl)-5-mercapto-1,2,3,4-tetrazole | 75 g/L |
| Telluric acid | 530 mg/L |
| Water | Balance |
| pH | <1 |

The silver electroplating composition was placed in a Hull cell which included a soluble silver anode. A brass panel 7.5 cm×10 cm was placed in the silver electroplating composition and the soluble silver anode and brass panel were connected to a conventional rectifier. Silver electroplating was done at 1 A for 5 minutes. The temperature of the plating composition was 60° C. The silver electroplating composition was agitated during plating. The panel was removed from the Hull cell, rinsed with DI water and air dried. The silver deposit had a uniform matte appearance as shown in FIG. 1*a*. At the top of FIG. 1*a* is a current density scale bar which shows the current density at which plating was done along the length of the brass panel. A second brass panel was then placed in the Hull cell with the silver electroplating bath at 40.8 Ah/L old. Electroplating was done at 1 A for 5 minutes. The brass panel was removed from the Hull cell, rinsed with DI water and air dried. The panel had a uniform matte appearance as shown in FIG. 1*b* which was substantially the same as the panel electroplated with silver using the freshly prepared composition. The cyanide-free acidic silver electroplating composition remained stable even after 40.8 Ah/L of ageing. No new composition was required to achieve the desired uniform matte appearance.

Example 2

The cyanide-free acidic silver electroplating composition of Table 1 was prepared and placed in a conventional high speed plating tank with conventional jet plating equipment to simulate the jet plating performance of the silver electroplating composition. The anode was a soluble silver electrode. A plurality of brass panels 7.5 cm×10 cm were silver electroplated at varying current densities as shown in Table 2 below and the silver deposit on each panel was observed after plating. Electroplating temperatures ranged from 60° C. to 65° C. The plating time was adjusted to keep the same film thickness; the time was reduced for high current density. The silver electroplating composition was agitated during plating. After plating the panels were rinsed with DI water and air dried. The results are shown in the table below.

TABLE 2

| CURRENT DENSITY ASD | DEPOSIT APPEARANCE |
|---|---|
| 2 | Uniform and Matte |
| 4 | Uniform and Matte |
| 6 | Uniform and Matte |
| 8 | Uniform and Matte |
| 10 | Uniform and Matte |
| 12 | Uniform and Matte |
| 14 | Uniform and Matte |
| 16 | Uniform and Matte |
| 18 | Uniform and Matte |
| 20 | Uniform and Matte |
| 22 | Uniform and Matte |
| 24 | Uniform and Matte |
| 26 | Uniform and Matte |

TABLE 2-continued

| CURRENT DENSITY ASD | DEPOSIT APPEARANCE |
|---|---|
| 28 | Matte but Non-uniform |
| 30 | Matte but Non-uniform |
| 32 | Matte but Non-uniform |

The cyanide-free acidic silver electroplating composition deposited silver layers which appeared uniform and matte at low plating speeds below 5 ASD as well as at high plating speeds exceeding 5 ASD and up to and including a plating speed of 26 ASD. Although matte deposits were achieved at plating speeds exceeding 26 ASD, the deposits did not appear uniform. In addition the silver electroplating composition appeared stable throughout the plating process.

Example 3

Figure 2:
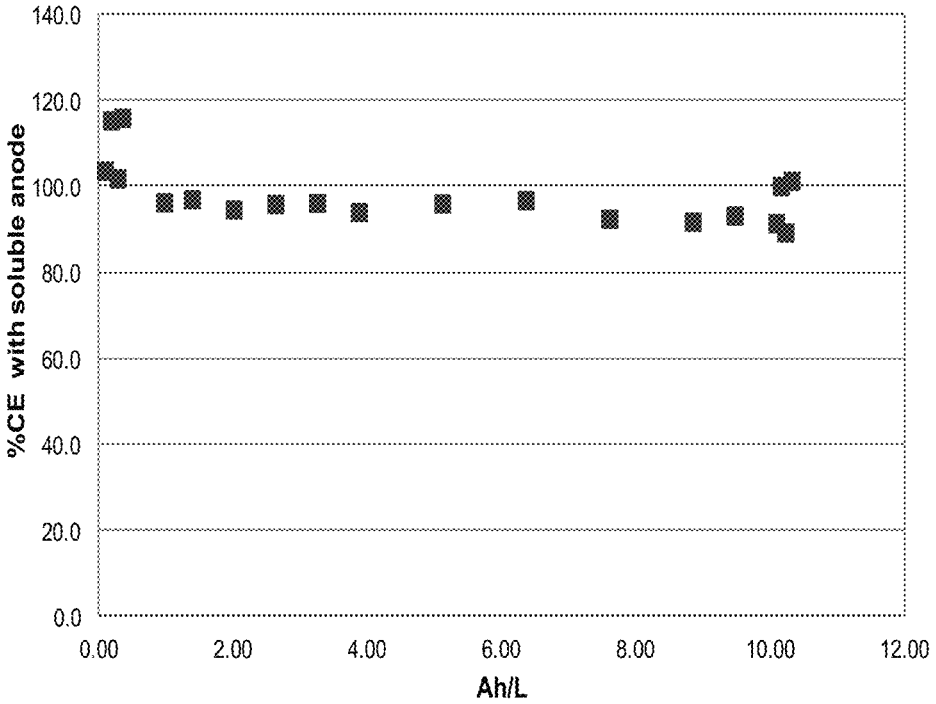
FIG. 2 is a graph of % current efficiency vs. bath age of a cyanide-free acidic silver electroplating bath.

The current efficiency of the cyanide-free acidic silver electroplating composition was measured as a function of bath age. The current efficiency was determined from the new or initial bath make up to a bath age of 10 Ah/L. The current efficiency is the ratio between the experimental mass of the deposit and the theoretical mass estimated by using Faraday's Law. Knowing the applied current (I), the plating time (t), the valence of silver (n=+1), the atomic mass of silver ($M_{Ag}$) and the Faraday constant (F), the theoretical mass was determined ($m=ItM_{Ag}/nF$). After plating the substrate was rinsed and dried before weighing Silver was electroplated on brass panels at bath temperatures of 60° C. to 65° C. Current density was 5 ASD. The anode was a soluble silver electrode. FIG. 2 shows the change in current efficiency over the bath age. The average % CE ranged from 95% to 98%. Values over 100% were due to experimental error. The average % CE over the life of the bath was determined to be 98%. The results showed that the current efficiency remained substantially the same throughout the bath aging, thus the bath was stable during the electroplating and the silver deposited on the panels was substantially uniform in thickness as well as having a substantially uniform matte appearance.

Example 4

A brass panel 5 cm×2.5 cm and 0.25 mm thick was electroplated with a 20 μm layer of silver from the cyanide-free acidic electroplating composition of Example 1. A soluble silver electrode was used as the anode. Silver electroplating was done at 60° C. and the current density was 5 ASD.

The micro Vickers Hardness was tested at room temperature for each plated brass panel using a Karl Frank DUROTEST™ 38541 Micro-Indentation Tester with a diamond tip. The applied mass was 25 g. The depth penetration of the indenter tip was less than or equal to 10% of the thickness of the silver layer on the brass panel. This assured that the underlying brass did not influence hardness results. The average hardness for the hard silver was determined to be 102 micro-hardness (HV).

The silver electroplated brass panel was then annealed for one hour at 150° C. in a conventional convection oven. The particular time and temperature were used because such conditions are one type of test typical among members of the industry for evaluating silver hardness performance. The panel was removed from the oven and allowed to cool to room temperature. The hardness of the silver layer was tested again. The hardness of the silver layer had an average hardness value of 101 HV. The results indicated that the hardness of the silver layer remained substantially the same after annealing. The exposure to heat did not substantially change the hardness of the silver layer on the brass panel.

Example 5

Four alkaline cyanide containing silver electroplating baths were prepared and included the components shown in Table 3.

TABLE 3

| BATH | COMPONENT | AMOUNT |
|---|---|---|
| 1 | Silver potassium cyanide | 45 g/L |
| | Potassium cyanide | 90 g/L |
| | Selenium | 0.15 mg/L |
| | Potassium carbonate | 15 g/L |
| | Non-ionic wetting agent for silver electroplating | 1.25 mL/L |
| 2 | Silver potassium cyanide | 36 g/L |
| | Potassium cyanide | 105 g/L |
| | Selenium | 0.17 mg/L |
| | Antimony | 620 mg/L |
| | Potassium carbonate | 15 g/L |
| | Non-ionic wetting agent for silver electroplating | 1.25 mL/L |
| 3 | [1]Silver potassium cyanide | 35 g/L |
| | Potassium cyanide | 340 g/L |
| | Potassium carbonate | 15 g/L |
| | Additive A | 25 mL/L |
| | Additive B | 15 mL/L |
| 4 | Potassium silver cyanide | 70 g/L |
| | Selenium | 0.4 mg/L |
| | Make up solution | 500 mL/L |
| | EO/PO surfactant | 2.5 mL/L |
| | Thiocarbamic acid derivative | 3 mL/L |

[1]SILVER GLEAM ™ 360 Silver Cyanide Electroplating Bath (Additive A and Additive B are proprietary components for alkaline silver electroplating baths) available from Dow Electronic Materials.

Each of the four alkaline cyanide silver baths was used to electroplate a silver layer 20 μm thick on brass panels 5 cm×2.5 cm and 0.25 mm thick. Baths 1-3 electroplated silver on the panels at 5 ASD. Bath 1 was at a temperature of 22° C. and Baths 2 and 3 were at 25° C. Bath 4 jet plated silver at 10ASD. The bath temperature was at 20° C.

A fifth panel was electroplated with the cyanide-free acidic silver electroplating bath of Table 1 in Example 1. Electroplating was done at 3 ASD and the bath temperature was 65° C. Plating was done until a 20 μm thick layer of silver was deposited on the brass.

Figure 3:
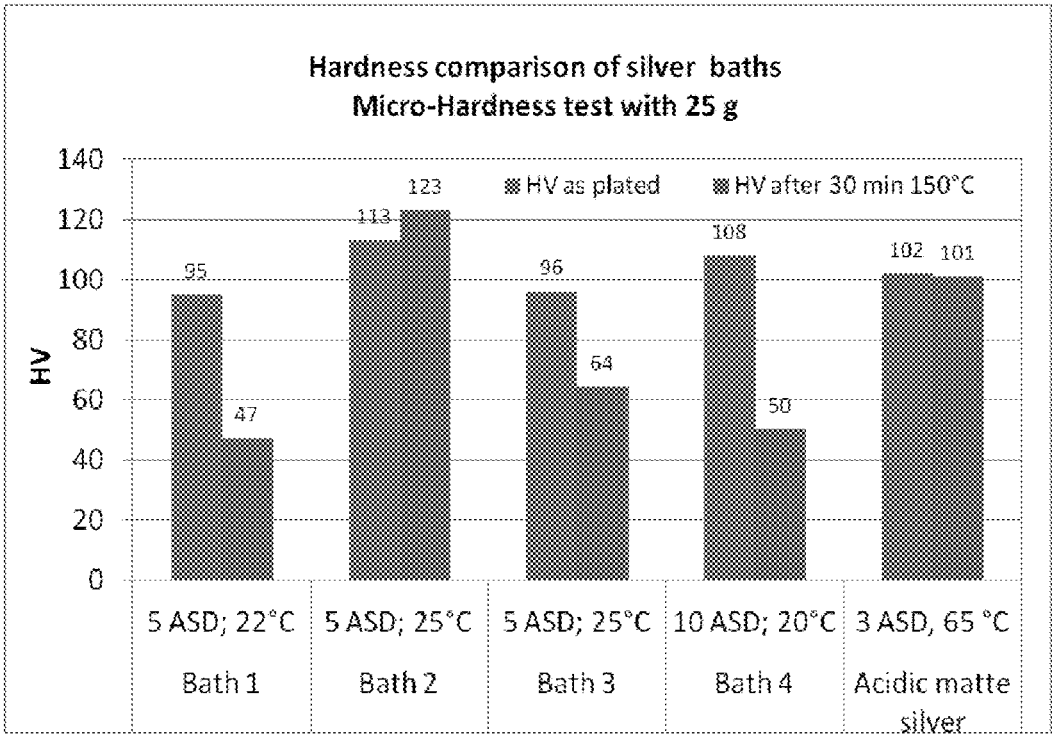
FIG. 3 is a bar graph of Vickers microhardness values of silver deposits electroplated from five different silver electroplating baths at makeup and after annealing each deposit for 30 minutes at 150° C.

After plating each panel was rinsed with DI water and air dried. The micro Vickers Hardness of the silver layer on each panel was then tested at room temperature using a Karl Frank DUROTEST™ 38541 Micro-Indentation Tester with a diamond tip. The applied mass was 25 g. The results are shown in the bar graph of FIG. 3 (left bar for each bath).

Each panel was then placed in a conventional convection oven and heated to 150° C. for 30 minutes. After heating the panels were removed from the oven and allowed to cool to room temperature. Each panel was again tested for the hardness of the silver layer. The hardness values are shown in the bar graph of FIG. 3 (right bar for each bath). With the exception of bath 2, all of the silver layers plated from the alkaline cyanide silver electroplating baths had significantly reduced hardness values. This may have been due to the presence of selenium. Although bath 2 included selenium, it also included antimony. The antimony which co-deposited with the silver may have helped to increase the hardness value. In contrast, the hardness of the silver layer plated from the cyanide-free acidic electroplating bath did not decrease but remained substantially the same.

Example 6

Brass panels 5 cm×10 cm and 0.25 mm thick were electroplated with the cyanide-free acidic silver electroplating bath of Table 1 or with the alkaline cyanide silver bath 1 of Example 5. Electroplating was done to form a 3 μm layer on the panels. The ductility of each plated brass panel was tested using a Bend-tester from SHEEN Instruments Ltd. according to ASTM standard B 489-85. The ductility measured for the silver layer deposited from the alkaline silver cyanide bath was determined to be 11%. In contrast, the ductility for the silver layer plated from the cyanide-free acidic bath was greater than 8%. Although the ductility of the silver layer plated from the cyanide-free acidic bath was less than the silver layer plated from the cyanide silver alkaline bath, the ductility of the silver from the cyanide-free bath still exceeded the industry requirement.

Example 7

A brass panel 5 cm×2.5 cm and 0.25 mm thick was plated with the cyanide-free acidic silver composition of Table 1 above. Electroplating was done in a plating cell at 60° C. The anode was a soluble silver electrode. Current density was 5 ASD. Plating was done until a silver layer 3 μm thick was deposited on the panel. The silver deposit had a uniform matte appearance. After plating the panels was rinsed with DI water and allowed to dry at room temperature.

The panel was then tested for corrosion resistance using the 96 hour neutral salt spray test according to ASTM B 177-97. No corrosion was observed on the silver layer. It still had the uniform matte appearance as observed immediately after plating. The corrosion performance was substantially as good as silver layers plated from many conventional alkaline cyanide silver baths.

Example 8

A brass panel 5 cm×2.5 cm and 0.25 mm thick was plated with the cyanide-free acidic silver composition of Table 1 above. Electroplating was done in a plating cell at 60° C. The anode was a soluble silver electrode. Current density was 5 ASD. Plating was done until a silver layer 3 μm thick was deposited on the panel. The silver deposit had a uniform matte appearance. After plating the panel was rinsed with DI water and allowed to dry at room temperature. The contact resistance of the silver layer was then measured using KOWI™ 3000 (available from WSK Mess-und Datentechnik GmbH) using the standard procedure of DIN EN™ 60512. The coated panel was attached on a gold electrode and the resistance between a gold tip (of about 1 mm diameter) and the surface was measure in dynamic force mode. The computer applied a load and a current simultaneously on the tip and measured the voltage from which the electrical interfacial resistance was calculated. The force was changed gradually and the corresponding resistance recorded. A resistance vs. force curve was displayed as the result of the measurement. The contact resistance was measured over a load range of 3 cN to 30 cN. The results are shown in the graph of FIG. 4.

Figure 4:
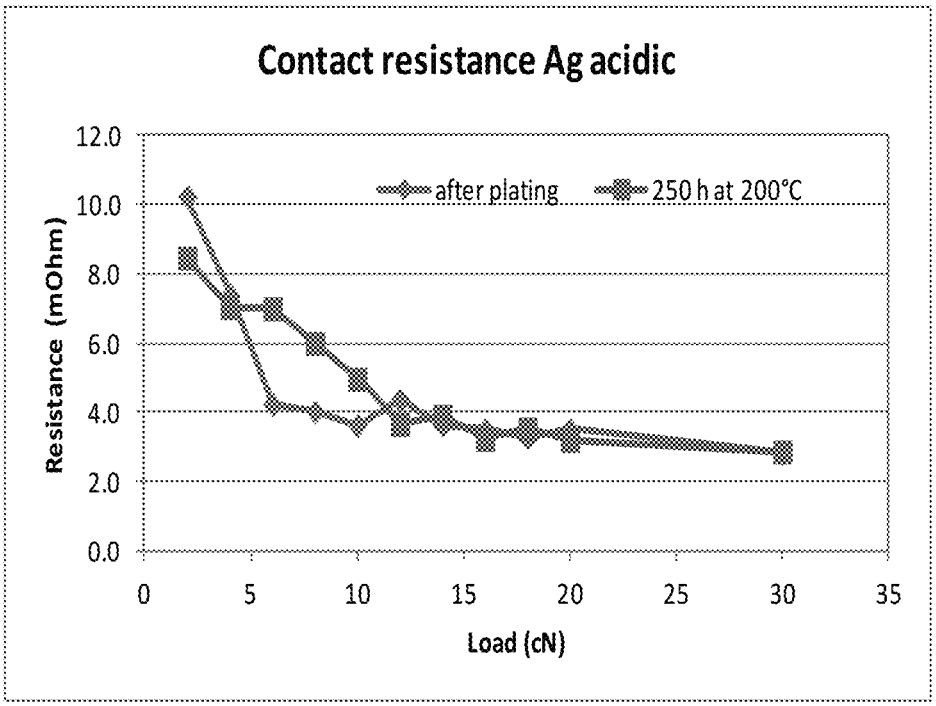
FIG. 4 is a graph of resistance in mOhm vs. load in cN comparing the contact resistance of a silver layer electroplated from a cyanide-free acidic silver electroplating bath at bath makeup and after annealing for 250 hours at 200° C.

The curve of FIG. 4 is a normal curve for this type of process. At low force the contact between the sample and gold tip is not very strong. Surface contaminants, adsorbed water, surface charge, thin oxide layer and dipoles may decrease electron flow at the interface of the sample and the tip. A stronger contact force may brake-down the layer of adsorbed water or oxide by pressure and establish high metal-to-metal contact. This metal-to-metal contact provides low interfacial resistance. This accounts for the decreasing contact resistance with the applied load.

The panel was then placed in a conventional convection oven and heated at 200° C. for 250 hours. The panel was removed from the oven and allowed to cool to room temperature. The contact resistance was then measured. This test is a general requirement for electrical vehicle connectors. The results are shown in the graph of FIG. 4. Although there was a deviation from 5 cN to 10 cN, the contact resistance before heating and after heating was substantially the same. The deviation may have been caused by the general environment or dust on the tip.

What is claimed is:

1. A method of electroplating silver comprising:

a) contacting a substrate with an acidic silver electroplating composition consisting of one or more sources of silver ions, wherein the one or more sources of silver ions are in amounts of 10 g/L to 80 g/L, one or more alkanesulfonic acids in amounts of 20 g/L to 250 g/L, telluric acid in amounts of 200 mg/L to 800 mg/L, water, a pH of 1 to less than 1, one or more optional compounds chosen from suppressors, surfactants and grain refiners, one or more dihydroxy bis-sulfide compounds in amounts of 10 g/L to 80 g/L, wherein the one or more dihydroxy bis-sulfide compounds are chosen from 2,4-dithia-1,5-pentanediol, 2,5-dithia-1,6-hexanediol, 2,6-dithia-1,7-heptanediol, 2,7-dithia-1,8-octanediol, 3,5-dithia-1,7-heptanediol, and 3,6-dithia-1,8-octanediol, and one or more mercaptotetrazoles in amounts of 5 g/L to 160 g/L, wherein the one or more mercaptotetrazoles are chosen from 1-(2-dimethylaminoethyl)-5-mercapto-1,2,3,4-tetrazole, and 1-(2-diethylaminoethyl)-5-mercapto-1,2,3,4-tetrazole, the acidic silver electroplating composition is substantially free of cyanide, wherein a ratio of a concentration of the one or more mercaptotetrazoles to a concentration of the one or more dihydroxy bis-sulfide compounds is 0.5:1 to 2:1; and b) electroplating uniform matte silver on the substrate with the acidic silver electroplating composition at a current density from 2-26 A/dm$^2$ and a temperature of 60-70° C.

2. The method of electroplating silver of claim 1, wherein a molar ratio of the one or more mercaptotetrazoles to silver ions is 0.5:1 to 2:1.

3. The method of electroplating silver of claim 1, wherein the dihydroxy bis-sulfide is 3,6-dithia-1,8-octanediol.

4. The method of electroplating silver of claim 1, wherein the mercaptotetrazole is 1-(2-dimethylaminoethyl)-5-mercapto-1,2,3,4-tetrazole.

5. The method of claim 1, wherein a bath age of the acidic silver electroplating composition is up to 40 Ah/L or greater.

6. The method of claim 1, wherein a bath age of the acidic silver electroplating composition is 10 Ah/L to 100 Ah/L.

* * * * *